US009855673B2

(12) United States Patent
Klaeusler et al.

(10) Patent No.: US 9,855,673 B2
(45) Date of Patent: Jan. 2, 2018

(54) METHOD FOR PRODUCING A VENEER

(75) Inventors: Oliver Frederik Klaeusler, Baar (CH); Glenn L. Wagoner, Darlington, PA (US)

(73) Assignee: HD WOOD TECHNOLOGIES LIMITED, Valletta (MT)

( * ) Notice: Subject to any disclaimer, the term of this patent is extended or adjusted under 35 U.S.C. 154(b) by 1541 days.

(21) Appl. No.: 13/578,159

(22) PCT Filed: Feb. 15, 2011

(86) PCT No.: PCT/EP2011/000716

§ 371 (c)(1),
(2), (4) Date: Oct. 16, 2013

(87) PCT Pub. No.: WO2011/098302

PCT Pub. Date: Aug. 18, 2011

(65) Prior Publication Data

US 2014/0027020 A1 Jan. 30, 2014

(30) Foreign Application Priority Data

Feb. 15, 2010 (EP) ..... 10001543

(51) Int. Cl.
*B27L 5/00* (2006.01)
*B44C 5/04* (2006.01)

(52) U.S. Cl.
CPC ..... *B27L 5/00* (2013.01); *B44C 5/043* (2013.01); *B44C 5/0415* (2013.01)

(58) Field of Classification Search
CPC ..... B27L 5/00; B44C 5/0415; B44C 5/043
See application file for complete search history.

(56) References Cited

U.S. PATENT DOCUMENTS

| | | | | |
|---|---|---|---|---|
| 3,205,111 | A * | 9/1965 | Williamson | B27L 5/00 144/332 |
| 3,878,016 | A | 4/1975 | Sadashige | |
| 3,897,581 | A | 7/1975 | Nakatsuka | |
| 3,969,558 | A | 7/1976 | Sadashige | |
| 3,977,449 | A | 8/1976 | Sadashige | |
| 3,977,933 | A | 8/1976 | Sadashige | |
| 4,293,362 | A | 10/1981 | Drobina | |
| 4,388,133 | A | 6/1983 | Hirao | |
| 5,040,582 | A | 8/1991 | Hsu | |
| 5,143,792 | A | 9/1992 | Cramer | |
| 2006/0162851 | A1* | 7/2006 | Engel | B27L 5/00 156/153 |

FOREIGN PATENT DOCUMENTS

| | | |
|---|---|---|
| CN | 101294442 | 10/2008 |
| CN | 101357470 | 2/2009 |
| EP | 1275481 | 1/2003 |
| EP | 1688228 | 8/2006 |
| FR | 2591933 | 12/1985 |
| JP | 3083632 | 4/1991 |
| JP | 10086107 | 7/1998 |
| JP | 2003276002 | 9/2003 |

OTHER PUBLICATIONS

CN 101294442 (English Translation of Abstract).
CN 101357470 (English Translation of Abstract).
DIN 52183, Nov. 1977. Prüfung von Holz; Bestimmung des Feuchtigkeitsgehaltes.
FR 2591933 (English Translation of Abstract).
JP 3083632 (English Translation of Abstract).
EP 10001543 Search Report, dated Jul. 7, 2010.
EP 10001543 Extended Search Report, including opinion.
EP10001543 Communication Pursuant to Article 94(3) EPC, including Annex Apr. 21, 2011.
EP10001543 Summons to Attend Oral Proceedings Pursuant to Rule 115(1) EPC, including accompanying Annex, Jun. 8, 2012.
JP 200327602 (English Translation of Abstract).
JP 10086107 (English Translation of Abstract).

* cited by examiner

*Primary Examiner* — Mark A Osele
*Assistant Examiner* — Christopher C Caillouet
(74) *Attorney, Agent, or Firm* — Calfee, Halter & Griswold LLP

(57) ABSTRACT

Method for manufacturing second wood sheets from first wood sheets, comprising steps (i) to (iv): (i) providing first wood sheets having a laminarly developed front side and backside, wherein the moisture content of said first wood sheets is below the fiber saturation point of the wood; (ii) applying a water-comprising adhesive to one or more front sides and/or one or more backsides of said first wood sheets provided in step (i); (iii) adhering said wood sheets from step (ii) and optionally from step (i) with laminar sides to each other in order to form a block which comprises adhered layers of said first wood sheets, wherein the adhering is performed such to increase the moisture content of said formed block up to or above the fiber saturation point of the wood; (iv) slicing said block formed in step (iii) to form said second wood sheets.

19 Claims, No Drawings

METHOD FOR PRODUCING A VENEER

CROSS REFERENCE TO RELATED APPLICATIONS

This application is the U.S. national phase entry of PCT/EP2011/000716, with an international filing date of 15 Feb. 2011, which claims the benefit of European patent application serial no. 10001543.7, with a filing date of 15 Feb. 2010, the entire disclosures of all which are fully incorporated herein by reference.

BACKGROUND

The invention relates to a process for producing a wood sheet from another wood sheet as starting material. Said wood sheets may be veneers.

The manufacture of veneers is a production technique for the manufacture of decorative, high-quality surface materials made from real wood. In the conventional manufacture, logs are decorticated or de-barked. Said logs are sawn into halves, thirds, quarters or other parts of a log (so called "flitches"). The flitches are mostly subsequently watered for several days at an increased temperature in order to prepare them for the subsequent cutting to veneer, the so-called slicing. Dependent on the cutting process, sliced veneer (horizontal or vertical slicing), peeled veneer (rotary slicing) or staylog (eccentrical rotary slicing) may be produced.

The obtained raw veneer, which typically has a thicknesses of from about 0.45 mm to 2.5 mm, preferably of from 0.45 mm to 0.8 mm, mostly is dried within some minutes, preferably at temperatures above 100° C. In case of strong corrugation, or "buckling," said veneer is additionally subjected to a pressing step. Subsequently, the dried raw veneer is cut to size and is sorted according to qualities. For said cutting to size, high material losses have to be accepted, which can be up to 60%. Material loss with the manufacture of a veneer is intensified by the fact that the starting material "wood" respectively "tree" is a natural product. Inclusions, limb rudiments and imperfections in the log are often unrecognizable, and may therefore result in defects in the raw veneer that frequently cannot be accepted for its further processing. All this may result in up to 85% material waste from the raw material log up to the final acceptable cut-to-size veneer.

The above described process steps are comprised by the so-called "European method" or "North American method" for the manufacture of veneers.

In another technical process, the so-called "Asian method", said raw veneer is obtained in a thickness of approximately from 0.1 mm to 0.8 mm. After the optional clipping of the edges (lengthwise), the still wet sheets of veneer are applied onto a substrate by means of gluing. Mostly the substrate is plywood. The customers buy the "fancy plywood" and cut out the part of the panel that they need. This results in low yields, as the needed sizes do not necessarily match the size of the plywood panel. Said "Asian method" requires an integrated process. The veneer after the slicing of the flitch/block has a high moisture content above the fiber saturation point of the wood. Leaving the sheet laying for a little while creates mold and deterioration of the veneers making them unusable. No storage or transportation over longer distances is possible. Only once the veneer is pressed on the substrate, the product can be transported/handled. The value of the substrate is considerably lower than the veneer itself. Thereby, a veneer product can be economically transported significantly farther than a fancy plywood product. This is particularly important with increasing transport cost.

So-called reconstituted veneers are also known. In the manufacturing process thereof, it is aspired to achieve a repeatable decorative property, a constant quality and a dimensional accuracy in order to be able to better predict the characteristics of the final product veneer. Conventionally manufactured veneers such as peeled veneers, optionally after a pretreatment such as dyeing or baking of structures, are glued to each other, and the so obtained material is subsequently re-sliced. Thereby, a veneer surface can be created having a mostly predetermined surface structure. Typically, soft wood species have to be used, otherwise the cutting process may be disadvantageously affected or even does not work at all. Due to the use of soft wood, the scratch resistance of the produced veneer may be impaired.

In another conventional process for the manufacture of reconstituted veneer, sliced or peeled hardwood veneer is laminated to a block and is re-sliced, wherein the block has a moisture content below the fiber saturation point. Since dried veneer is used, the resulting sheet is usually brittle and thus difficult to handle. Processing is limited with regard to parameters such as width and length of the veneer, since dry wood can be sliced only within narrow parameters. Typically, such a veneer needs to be glued on a substrate before further processing. This adds costs to the manufacturing process.

Specific manufacturing processes for a veneer are e.g. disclosed in the following documents of the prior art:

EP 1 275 481 discloses a process for the manufacture of wood veneer, wherein printed wood sheets having a moisture content of approximately 4% are glued together to form a flitch. After the glue hardening, the resulting flitch is sliced.

U.S. Pat. Nos. 3,977,449 and 3,878,016 disclose a process for the manufacture of wood veneer wherein individual flitches are glued to each other by means of an adhesive to form a composite flitch. The composite flitch is subsequently sliced to form a wood sheet such as a veneer which is glued to a substrate by means of an adhesive. Throughout, all process steps are carried out while the wood is maintained at a moisture content at or above the fiber saturation point of the wood. Also the moisture content of the obtained veneer is kept at or above the fiber saturation point prior to the gluing on a substrate.

U.S. Pat. No. 3,969,558 discloses the gluing of short pieces of a wooden beam to each other, which subsequently can be sliced. For the gluing, adhesives such as epoxy resin, phenolic resin and resorcinol resin are suggested. During the whole process, the moisture content of the wood is permanently held on or above the fiber saturation point. The produced veneer, which has a moisture content above the fiber saturation point of the wood is overlaid and glued onto a substrate.

U.S. Pat. No. 3,977,933 discloses a process for the manufacture of a veneer and fancy plywood therefrom. Herein, composite flitches made up of glued smaller flitches or sliced large veneer may be sliced to veneer, which subsequently is glued onto a substrate. All steps may be carried out at or above the fiber saturation point.

U.S. Pat. No. 5,143,792 discloses a method of forming a flitch from sheets of veneer, wherein the flitch is subjected to cooking in water before slicing.

U.S. Pat. No. 3,897,581 discloses a process for the manufacture of wood veneer, wherein wet wood pieces having a water content of more than 25% are glued to each other using a liquid anhydrous isocyanate-containing adhesive. The thus bonded wood can be cut with a rotary lathe, a slicer or a disc saw.

U.S. Pat. No. 4,293,362 discloses a process, wherein a composite consisting of glued wood sheets is cut into pieces. The pieces are glued on a backing member.

U.S. Pat. No. 4,388,133 discloses a method for producing a veneer, wherein material veneers are joined through a binder to form a flitch. Subsequently, the flitch is sliced to form an artificial wood veneer.

JP 10086107 discloses reconstituted veneer for plywood, wherein a general veneer for plywood is bonded to one another with a foam adhesive to make a log-like formed body. Said body is formed in a veneer in the same process as an ordinary log.

FR 2591933 discloses a process for the manufacture of a reconstituted veneer in a thickness of about 2 mm.

JP 3083632 discloses a structure of laminated veneers and aluminum sheets.

JP 2003276002 discloses an artificial veneer obtained from a laminated flitch by slicing.

CN 101357470 discloses a method for manufacturing reconstituted wood.

CN 101294442 discloses a method, wherein a plurality of wood single plates, which is integrated into a blank, is cut.

EP 1 688 228 discloses a process for the manufacture of wood veneer, wherein board-like plane pieces of wood are glued to each other to form a beam-like block of wood. Prior to the slicing, said block is watered. The obtained veneer is dried until the moisture content of the wood is below the fiber saturation point.

DETAILED DESCRIPTION

The invention is based on the problem to create a wood sheet such as a veneer, which avoids as far as possible one or more of the following: the problem of inconsistency of color; defects in the veneer created by natural defects in the used raw material; brittleness; material waste. Additionally, the appearance, structure and aesthetics of said wood sheet should not only be predetermined by the used log, respectively raw material, but also should be definable by the applicant's or designer's wish.

This problem is solved by a process for the manufacture of a wood sheet such as a veneer by providing wood sheets such as sliced or peeled dry veneer sheets of desired thickness depending on the desired design and/or optical properties, which are glued to a block comprising said glued wood sheets. An aqueous glue is employed for gluing. The gluing is performed such to allow water penetrating from the glue into the wood of the wood sheet thus raising the moisture content of said wood up to or above the fiber saturation point of said wood. A veneer may be produced by slicing said block. Due to the moisture content of the wood, such slicing may be performed smoothly without affecting the strong glue joints provided by the aqueous glue. The produced veneer may be designed to exhibit predetermined aesthetical properties. The employed wood and glue may be colored or dyed. Furthermore, due to the possible use of hardwood, scratch-resistant veneers may be produced. The use of different wood species as well as the incorporation of non-wooden material such as metal or metal powder, glitter, plastic, etc. is also possible in order to vary mechanical and optical properties. The produced sheet or veneer may be easily processed. Furthermore, the advantageous use of lower grade veneer for the manufacture of said block or flitch is possible without affecting the properties of the veneer to be produced.

In a first aspect, the invention relates to a process for the manufacture of second wood sheets from first wood sheets, comprising steps (i) to (iv):

(i) providing first wood sheets having a laminarly developed front side and backside, wherein the moisture content of said first wood sheets is below the fiber saturation point of the wood;

(ii) applying a water-comprising adhesive to the front side and/or the backside of one or more of said first wood sheets provided in step (i);

(iii) adhering wood sheets from step (ii) and optionally from step (i) with laminar sides to each other in order to form a block which comprises adhered layers of said first wood sheets, wherein the adhering is performed such to increase the moisture content of said formed block up to or above the fiber saturation point of the wood;

(iv) slicing said block formed in step (iii) to form said second wood sheets.

Definition of Terms as Used Herein

The term "wood sheet" defines any piece of wood having a laminarly developed front side and backside. Said front side and said backside are spaced from each other by the thickness dimension of the sheet. Preferably, the thickness throughout the sheet is constant or is nearly constant. This means that the front side and the back side preferably are in parallel towards each other. There is no restriction concerning said thickness as long as the length and the width of said wood sheets is larger than said thickness.

The term "dry wood sheet" defines a wood sheet, which has a moisture content below the fiber saturation point of said wood.

The term "fiber saturation point" defines the point in the drying process of moist wood where said wood predominantly contains no "free" water however only "bonded" water. "Free" water is in the cell cavities of the wood, whereas "bonded" water is in the cell walls of the wood.

The moisture content is determined according to DIN 52183. Other determination methods may also be used, such as electrical methods (measurement of the ohmic resistance) or the determination via reflection of infrared radiation. However, it is advisable to use the above DIN method as a calibration method in order to obtain comparable values.

The term "wood" comprises softwood and hardwood. The term "hardwood" comprises the wood of broadleaf trees.

The term "water-comprising adhesive" defines any compound which contains water and which is capable of bonding at least two of said first wood sheets to each other in order to form a block comprising said first wood sheets. Said compound may be present in said water in the form of a solution, an emulsion, a suspension or a dispersion. Accordingly, the terms "solution", "suspension", "emulsion" and "dispersion" are interchangeably used herein. The term "adhesive" is interchangeably used with the term "glue". The terms "adhering" and "gluing" are interchangeably used.

The term "veneer" is used in the meaning as discussed in the background section above and represents a distinct species of a wood sheet having a thickness of from 0.1 mm to 3 mm, preferably of from about 0.45 mm to 2.5 mm, more preferably of from 0.45 mm to 0.8 mm. The terms "veneer sheet" or "sheet of a veneer" are interchangeably used with the term "veneer".

The term "block" defines a composite made from wood sheets or veneers. The term is interchangeably used with the term "flitch".

The term "slicing" is interchangeably used with the term "cutting". Said slicing or cutting relates to the formation of a wood sheet such as a veneer from a flitch by means of a knife, a blade or the like. In the context of the present invention, the first wood sheets such as veneers in the form of a block or flitch are cut or sliced, however not sawn or otherwise formed in a fiber removing (machining) process.

The term "adhesion layer" defines the layer of adhesive between two laminar sides of the first wood sheets, which are adhered to each other.

Step (i)

Step (i) requires to provide first wood sheets having a laminarly developed front side and backside, wherein the moisture content of said first wood sheets is below the fiber saturation point of the wood.

Such wood sheet, preferably in the form of a veneer, may be produced according to a process according to the "European method". However, such sheet may also be provided in the form of a sawn board which e.g. is obtained from a log by sawing.

If necessary, said sheet is subjected to a drying step prior to the providing in step (i) in order to exhibit the required moisture content below the fiber saturation point of the wood. Drying may be performed by applying hot air to said sheets.

Preferably, the moisture content of said first wood sheets is below 50%, still more preferred below 40%, more preferred below 30%. In particular, the water content is below 20%. Very particularly preferred wood sheets have a moisture content between 5 and 20%.

In one embodiment, the thickness of the first wood sheets provided in step (i) is from 0.1 mm to 3 mm.

In one embodiment, said wood sheet provided in step (i) is a veneer, preferably a sliced or peeled veneer. Preferably, said veneer has a thickness of from about 0.45 mm to 2.5 cm, more preferred of from 0.45 mm to 0.8 mm.

In one embodiment, said first wood sheets, preferably in the form of a veneer, as provided in step (i) comprise hardwood or are made from hardwood. Examples of hardwood are, but not limited to, oak, maple and beech.

In one embodiment, the density of the wood the first wood sheets are made from ranges from 0.1 to 1.5 g/cm$^3$ measured according to DIN 52182. In other embodiments, the density is from 0.4 to 1.3 g/cm$^3$ or from 0.5 to 1.2 g/cm$^3$. In one embodiment, the density is from 0.6 to 0.9 g/cm$^3$.

In one embodiment, the density of the wood the first wood sheets are made from ranges from 0.1 to 1.5 g/cm$^3$ and the moisture content of the first wood sheet is below 50%, still more preferred below 40%, more preferred below 30%, in particular below 20%, or ranges from 5 to 50%, or from 5 to 40%, or from 5 to 30%, or from 5 to 20%.

In one embodiment, the density of the wood the first wood sheets are made from ranges from 0.4 to 1.3 g/cm$^3$ and the moisture content of the first wood sheet is below 50%, still more preferred below 40%, more preferred below 30%, in particular below 20%, or ranges from 5 to 50%, or from 5 to 40%, or from 5 to 30%, or from 5 to 20%.

In another embodiment, the density of the wood the first wood sheets are made from ranges from 0.5 to 1.2 g/cm$^3$ and the moisture content of the first wood sheet is below 50%, still more preferred below 40%, more preferred below 30%, in particular below 20%, or ranges from 5 to 50%, or from 5 to 40%, or from 5 to 30%, or from 5 to 20%.

In still another embodiment, the density of the wood the first wood sheets are made from ranges from 0.6 to 0.9 g/cm$^3$ and the moisture content of the first wood sheet is below 50%, still more preferred below 40%, more preferred below 30%, in particular below 20%, or ranges from 5 to 50%, or from 5 to 40%, or from 5 to 30%, or from 5 to 20%. Fundamentally, arbitrary wood sheets can be employed in step (i). For example, wood sheets from varying solid wood parts of a log can be employed. The thickness or "gage" of such solid wood sheets is not critical for the process according to the invention.

It is possible to provide in step (i) a first wood sheet which comprises different wood species. It is also possible to provide first wood sheets, each of which is made from a different wood species. In one embodiment of the present invention, wood sheets of different wood species are glued to each other. In this manner, it is possible to generate from step (i) via steps (ii) to (iv) veneers or veneer patterns, which are striated, thin, linear looking veneer patterns and which cannot be produced by means of the conventional technique such as the "European method" or "Asian method". Such veneers and veneer patterns may be termed as "industrial inlays" or "reconstituted veneers" as discussed in the background section.

Step (ii)

Step (ii) requires to apply a water-comprising adhesive to the front side and/or the backside of one or more of said first wood sheets provided in step (i).

A variety of water-comprising adhesives is known that may be employed in the process of the invention. Preferably, said compound being present in said water-comprising adhesive is selected from a natural or synthetic organic polymer.

In one embodiment, said polymer is selected such to result in an aqueous dispersion that is as stable as possible and which allows a good adhering of the first wood sheets to each other. Methods of producing such dispersions are known in the art.

Particularly suitable for the process according to the invention are polymers selected from the group consisting of polyvinyl acetate, polyvinyl alcohol, and partially saponified polyvinyl acetate. Ethylene vinylactetate copolymers, phenolic resins, and urea resins may also be suitable. Polyurethanes may also be used.

In one embodiment, the solids content of the water-comprising adhesive ranges from 30 to 80% by weight based on the total weight of the water-comprising adhesive. In other embodiments, the solids content ranges from 40 to 70% by weight, or from 50 to 60% by weight.

The water-comprising adhesive preferably comprising one of the above addressed polymers may be applied to the front side and/or backside of the first wood sheets by conventional methods that are known in the art. In one embodiment, said adhesive may be applied by spraying, by means of rollers, by brushing, or by dunking.

In one embodiment, the water-comprising adhesive is applied in an amount of from 100 g to 150 g per m$^2$ first wood sheet, or from 110 to 140 g/m$^2$.

Step (iii)

Step (iii) requires to adhere wood sheets from step (ii) and optionally from step (i) with laminar sides to each other in order to form a block which comprises adhered layers of said first wood sheets, wherein the adhering is performed such to increase the moisture content of said formed block up to or above the fiber saturation point of the wood.

In a particularly preferred embodiment, said water from said water-comprising adhesive increases during adhering the moisture content up to or above the fiber saturation point of the wood.

Accordingly, the ratio of water to polymer is selected such that during adhering enough water is present to increase the moisture content of the wood up to or above the fiber saturation point of the wood. The necessary amount of water may be e.g. determined by experiments. Said amount may depend on the used polymer and the used wood species in the first wood sheets to be glued to each other.

In one embodiment, the moisture content of the block or flitch obtained in step (iii) prior to the slicing according to step (iv) is above 30%, more preferred above 40%, still more preferred above 50%. The upper limit is 100%, respectively.

In one embodiment, the moisture content is from 30 to 40%. In another embodiment, the moisture content is from 40 to 50%. In still another embodiment, the moisture content is from 50 to 60%. In another embodiment, the moisture content is between 60% and 80%.

In order to accelerate the adhering and said increasing according to step (iii) and/or to intensify the adhering and/or said increasing, step (iii) may be performed by applying pressure to the first wood sheets to be adhered to each other. A suitable pressure preferably ranges between 1 bar and 200 bar. In one embodiment, the pressure is between 1 and 160 bar.

Furthermore, said water-comprising adhesive must provide an at least satisfying adhesive connection between the first wood sheets to be glued, which is not affected by the further processing preferably according to step (iv). In said context, it is understandable that said adhesive/glue must be able to provide a fixed, stable composite between the glued wood sheets. The adhesive must resist a treatment of the block of wood which was obtained by the adhesion by slicing or cutting as well as a treatment of the veneer that was obtained after the slicing, for example a treatment by drying.

Furthermore, depending on the wood species of the first wood sheets to be glued, different water-containing adhesives may be employed, which are adapted to said wood species.

In one embodiment, the block formed in step (iii) is not subjected to a further or another treatment with water in order to increase the moisture content thereof. In one embodiment, the block formed in step (iii) is not subjected to hot water such as boiling water. Specifically, the block formed in step (iii) is not subjected to a boiling step in water.

Step (iv)

Step (iv) requires to slice said block formed in step (iii) to form said second wood sheets. The slicing according to step (iv) to produce the second wood sheets may be performed according to slicing methods as referenced to in the background section using standard veneer slicing equipment.

For the creation of various surface patterns of the second wood sheets produced according to the method of the invention, the section plane along which the block of wood as obtained in step (iii) is cut or sliced can be freely selected. Here, it is possible, by appropriate selection of the section plane, also to carry out a rotary slicing or a staylog process. Preferably, it is processed in a manner that one cuts transversely, in particular perpendicularly to a plane which is defined by the adhesion layers of the first wood sheets.

In one embodiment, the slicing in step (iv) is performed such that the block is sliced in a direction which is perpendicular to the plane which is defined by the adhesion layers of the adhered first wood sheets; or wherein in step (iv) the block is sliced in a direction which is horizontal to the plane which is defined by the adhesion layers of the adhered first wood sheets; or wherein in step (iv) the block is sliced in a direction which is inclined to the plane which is defined by the adhesion layers of the adhered first wood sheets.

In one embodiment, the second wood sheet produced in step (iv) is a veneer. In a preferred embodiment, both the first and the second wood sheet is a veneer.

In one embodiment, said second wood sheet, preferably said veneer, has a thickness from 0.1 mm to 2.5 mm. Preferably, second wood sheets are produced having a front side and a backside, the surface of each is of from 0.5 to 4 $m^2$. In one embodiment, the surface is from 0.9 to 1.5 $m^2$. In another embodiment, the surface is from 1.5 to 3.5 $m^2$.

In a preferred embodiment, the length of the veneer obtained in step (iv) essentially corresponds to the length of said block of wood sheets.

In one embodiment, the invention relates to a method for producing second wood sheets from first wood sheets, comprising steps (i) to (iv):

(i) providing first wood sheets having a laminarly developed front side and backside, wherein the moisture content of said first wood sheets is below the fiber saturation point of the wood;

(ii) applying a water-comprising adhesive to one or more front sides and/or one or more backsides of said first wood sheets provided in step (i);

(iii) adhering said wood sheets from step (ii) and optionally from step (i) with laminar sides to each other in order to form a block which comprises adhered layers of said first wood sheets, wherein the adhering is performed such to increase the moisture content of said formed block up to or above the fiber saturation point of the wood;

(iv) slicing said block formed in step (iii) to form said second wood sheets, wherein the block formed in step (iii) is not subjected to a another treatment with water in order to increase the moisture content thereof.

Optional Steps

Preferably, the second wood sheets, preferably a veneer, produced in step (iv), are subjected to a drying step. Preferably, the drying is performed until a moisture content below the fiber saturation point of the wood is reached. Accordingly, in one embodiment, the method comprises step (v):

(v) drying said second wood sheets formed in step (iv) until a moisture content below the fiber saturation point of the wood is reached.

Preferably, said drying is carried out at an increased temperature, in particular at a temperature which, dependent on the species of wood and the moisture content thereof, varies between 70° C. and 100° C. In applying increased temperatures, in particular applying temperatures >90° C., usually drying periods up to several minutes are sufficient for a satisfactory drying of the obtained second wood sheet. Preferably, the drying is carried out directly after said slicing in step (iv).

The mechanical and/or optical properties of the second wood sheet can not only be varied by the selection of the slicing planes during the cutting/slicing process according to step (iv).

In one embodiment, materials being different from wood may be inserted or incorporated between the first wood sheets prior to the gluing according to step (iii). Preferably, said materials are provided in the form of thin layers of powder or sheets.

Preferably, the mentioned materials being different from wood are metals or metal alloys such as aluminum or aluminum alloys. Plastics such as polyolefins such as polypropylene or copolymers with such polyolefins may also be used.

In one embodiment, such material may be a metal sheet or a plastic sheet. In another embodiment, a metal powder or glitter is employed.

In one embodiment, said materials being different from wood are inserted or incorporated by gluing. In one embodiment, the addressed adhesives are employed. The arrangement and the sequence of the first wood sheets and said other material can be arbitrarily varied. In this manner, novel second wood sheets, preferably veneers, can be created that consists not only of wood, but also consist of a composite comprising wood and a material being different from wood.

Just by the combination of wood with materials being different from wood, novel surface patterns and, therewith, a completely new material aesthetic can be created which enlarges the application range of wood veneer. The manufacture of variously structured and striated, thin, linear looking veneers is possible.

In one embodiment, a colored adhesive or a dyed adhesive is employed as water-comprising adhesive. With it, also new decorative effects can be achieved which embrace the color of such an adhesive. It is possible to adapt the color of the adhesive to the color of the employed first wood sheets, respectively to the color of the material, which is inserted between first wood sheets. However, the color of the adhesive can also be selected to contrast to the color of the employed first wood sheets, respectively to the color of the material, which is inserted between first wood sheets. Thereby, in the second wood sheets produced according to step (iv), further decorative effects may be achieved. For said purpose, optionally, also thicker adhesive layers can be used as it would be required for the technical function of the adhering.

In another embodiment, also the first wood sheets are either colored or dyed. It is also possible to color or dye said materials being different from wood. Accordingly, the materials employed in the method according to the invention are not only restricted to their "natural" color, however, additional further decorative effects can be achieved.

Different veneer types (different species of wood, different patterns from wood and other materials, from colored or dyed adhesives, etc.) can be produced and can be converted according to customers' requirements.

In one embodiment, the front side, respectively the backside of the first wood sheets, respectively the second wood sheets, are subjected to a planing or a sanding process. By means of the planing or sanding of the front side, respectively the backside of the first wood sheets, the compact and permanent connection between said first wood sheets may be improved. In the produced second wood sheets, optically pleasing respectively hardly visible glue joints result after planing or sanding.

The second wood sheets, preferably veneers, which are obtained from the process according to the invention can be further converted by the manufacturer of the veneer himself, for example by the application onto a substrate such as plywood.

The method according to the invention may further comprise one or more of the following steps (vi) to (xi):

(vi) dyeing said adhesive prior to or after said applying in step (ii);

(vii) dyeing said first wood sheet prior to said applying in step (ii) or prior to said adhering in step (iii);

(viii) inserting glitter between two wood sheets to be adhered in step (iii);

(ix) inserting metal powder between two wood sheets to be adhered in step (iii);

(x) inserting a metal sheet between two wood sheets to be adhered in step (iii);

(xi) inserting a plastic sheet between two wood sheets to be adhered in step (iii);

(xii) planing and/or sanding the front side and/or the backside of the second wood sheet;

(xiii) gluing the second wood sheet onto a substrate.

The new process allows the use of a multitude of kinds of wood in step (i). Nearly all commercially used kinds of woods may be employed, contrary to the reconstitution processes of the prior art, which require relatively soft kinds of wood. Since the process does not require an additional watering process in step (iii), comparatively reduced production times may be achieved. Also possible disadvantageous staining of the wood is avoided. The method may be performed on and with standard machines used in the art. This significantly reduces production costs, while maintaining a high quality of the formed second wood sheet.

In a second aspect, the invention relates to a method for producing second wood sheets from first wood sheets, comprising steps (i) to (iv):

(i) providing first wood sheets having a laminarly developed front side and backside, wherein the moisture content of said first wood sheets is above the fiber saturation point of the wood;

(ii) applying an adhesive to one or more front sides and/or one or more backsides of said first wood sheets provided in step (i);

(iii) adhering said wood sheets from step (ii) and optionally from step (i) with laminar sides to each other in order to form a block which comprises adhered layers of said first wood sheets;

(iv) slicing said block formed in step (iii) to form said second wood sheets.

In one embodiment, the adhesive applied in step (ii) is a water-free adhesive.

Suitable adhesives for step (ii) are, among other types, adhesives based on polyurethane such as one-component polyurethane adhesives or two-component polyurethane adhesives. Thermal polyurethane adhesives may also be employed. Such polyurethanes are known in the art.

One-component polyurethane adhesives are applied as a single product, whereby the adhesive cures to a water insoluble resin by means of its content of isocyanate groups which react with the wood moisture and/or polar groups being contained in the wood. Two-component polyurethane adhesives are applied from two different ingredients, and also cure by means of the wood moisture. Thermal polyurethane adhesives (so-called "hotmelts") are applied in a hot form and should be quickly processed. Also here, the curing takes place by means of the wood moisture and/or polar groups being contained in the wood. In the curing process, said hotmelts change from a thermoplastic to a thermosetting state.

Preferably, one-component polyurethanes having a content of isocyanate groups are those which are disclosed in the U.S. Pat. No. 3,897,581, the disclosure of which is incorporated into the present invention by reference. It is preferred to apply polyurethanes which were prepared by the reaction of a suitable polyglycol with an appropriate polyisocyanate. Preferably, the reaction is carried out in a way that said polyisocyanate is applied in a stoichiometrical surplus in order to ensure a content of isocyanate groups in the resulting polyurethane that can be adjusted to the property requirements of the block of wood to be glued.

Preferred polyglycols are polyethylene glycol or polypropylene glycol. Particularly, said polyglycol is polypropylene glycol.

Preferably, the polyisocyanate is selected from the group consisting of hexamethylene diisocyanate, xylylene diisocyanate, tolylene diisocyanate, diphenylmethane diisocyanate, dimethyl diisocyanate, hydrogenated diphenylmethane diisocyanate, hydrogenated tolylene diisocyanate, hydrogenated xylylene diisocyanate, and mixtures thereof.

The reaction product of diphenylmethane diisocyanate and/or hydrogenated diphenylmethane diisocyanate with a polyglycol is particularly preferred, particularly with polypropylene glycol.

Advantageous properties may be achieved if a polyurethane adhesive is employed, which comprises the reaction product of diphenylmethane diisocyanate with a polyglycol, in particular with propylene glycol.

In one embodiment, said diphenylmethane diisocyanate comprises a mixture of diphenylmethane 4,4'-diisocyanate and diphenylmethane 2,4'-diisocyanate.

It is further preferred that said polyisocyanate of said particularly preferred embodiment optionally also comprises modified diphenymethane diisocyanates, such as hydrogenated diphenymethane diisocyanates, or homologous isocyanates.

Preferably, the isocyanate content in said polyurethane may range between 5 and 25% by weight based on the total amount of said adhesive, more preferred between 10 and 20%, particularly between 13 and 16%.

In one embodiment, the first wood sheets as provided in step (i) and/or the block formed in step (iii) are not subjected to a treatment with water in order to increase the moisture content thereof. In one embodiment, the block formed in step (iii) is not subjected to a treatment with water in order to increase the moisture content thereof. In one embodiment, the block formed in step (iii) is not subjected to hot water such as boiling water. Specifically, the block formed in step (iii) is not subjected to a boiling step in water.

In one embodiment, the invention relates to a method for producing second wood sheets from first wood sheets, comprising steps (i) to (iv):

(i) providing first wood sheets having a laminarly developed front side and backside, wherein the moisture content of said first wood sheets is above the fiber saturation point of the wood;

(ii) applying an adhesive to one or more front sides and/or one or more backsides of said first wood sheets provided in step (i);

(iii) adhering said wood sheets from step (ii) and optionally from step (i) with laminar sides to each other in order to form a block which comprises adhered layers of said first wood sheets;

(iv) slicing said block formed in step (iii) to form said second wood sheets, wherein the adhesive applied in step (ii) is a water-free adhesive, and the first wood sheets as provided in step (i) and/or the block formed in step (iii) are not subjected to a treatment with water in order to increase the moisture content thereof.

The invention claimed is:

1. A method for producing one or more second wood sheets from first wood sheets, comprising:

(i) providing first wood sheets having a laminarly developed front side and backside, wherein the moisture content of the first wood sheets is below the fiber saturation point of the wood;

(ii) applying a water-comprising adhesive to at least one front side, at least one backside, or at least one front side and at least one backside of the first wood sheets;

(iii) adhering the first wood sheets from (ii) and optionally from (i) with laminar sides to each other thereby forming a block of adhered layers, wherein the adhering is performed such as to increase the moisture content of the block of adhered layers up to or above the fiber saturation point of the wood wherein the moisture content of the block of adhered layers is increased to 30-100%; and (iv) slicing the block of adhered layers to form at least one second wood sheet.

2. The method according to claim 1, wherein the water of the water-comprising adhesive increases the moisture content of the block of adhered layers up to or above the fiber saturation point of the wood.

3. The method according to claim 1, wherein the thickness of the first wood sheets is from 0.1 mm to 3 mm.

4. The method according to claim 1, wherein the moisture content of the first wood sheets provided in (i) is below 30%.

5. The method according to claim 1, wherein at least one of the first wood sheets and the second wood sheet or sheets is a veneer.

6. The method according to claim 1, wherein the first wood sheets are sliced or peeled veneer.

7. The method according to claim 1, wherein the first wood sheets provided in (i) comprise hardwood.

8. The method according to claim 1, wherein the first wood sheets provided in (i) comprise at least two different wood species.

9. The method according to claim 1, wherein the water-comprising adhesive is an aqueous suspension of an organic polymer.

10. The method according to claim 9, wherein the organic polymer is selected from the group consisting of a polyvinyl acetate, a polyvinyl alcohol, a partially saponified polyvinyl acetate, an ethylene vinylactetate copolymer, a phenolic resin, a urea resin, a polyurethane resin, and combinations thereof.

11. The method according to claim 1, wherein (iii) is performed under pressure.

12. The method according to claim 1, wherein the block of adhered layers has a moisture content of greater than 40% prior to (iv).

13. The method according to claim 1, wherein (iv) comprises one of:

slicing the block of adhered layers in a direction which is perpendicular to the plane which is defined by the adhesion layers of the adhered first wood sheets;

slicing the block of adhered layers in a direction which is horizontal to the plane which is defined by the adhesion layers of the adhered first wood sheets; or slicing the block of adhered layers in a direction which is inclined to the plane which is defined by the adhesion layers of the adhered first wood sheets.

14. The method according to claim 1, further comprising:

(v) drying the second wood sheet or sheets until a moisture content below the fiber saturation point of the wood is reached.

15. The method according to claim 14, further comprising at least one of the following:

dyeing the water-based adhesive prior to or after the applying in (ii);

dyeing at least one of the first wood sheets prior to the applying in (ii) or prior to the adhering in (iii);

inserting glitter between at least two of the first wood sheets prior to the adhering in (iii);

inserting metal powder between at least two of the first wood sheets prior to the adhering in (iii);

inserting a metal sheet between at least two of the first wood sheets prior to the adhering in (iii);

inserting a plastic sheet between at least two of the wood sheets prior to the adhering in (iii);

planing the front side, the backside or both the front side and the backside of at least one second wood sheet;

sanding the front side, the backside or both the front side and the backside of at least one second wood sheet; and gluing at least one second wood sheet onto a substrate.

16. The method according to claim 1, wherein the water-comprising adhesive has a solids content of 30-80% by weight based on the total weight of the water-comprising adhesive.

17. The method according to claim 1, further comprising at least one of the following:

dyeing the water-comprising adhesive prior to or after the applying in (ii);

dyeing at least one of the first wood sheets prior to the applying in (ii) or prior to the adhering in (iii);

inserting glitter between at least two of the first wood sheets prior to the adhering in (iii);

inserting metal powder between at least two of the first wood sheets prior to the adhering in (iii);

inserting a metal sheet between at least two of the first wood sheets prior to the adhering in (iii);

inserting a plastic sheet between at least two of the wood sheets prior to the adhering in (iii);

planing the front side, the backside or both the front side and the backside of at least one second wood sheet;

sanding the front side, the backside or both the front side and the backside of at least one second wood sheet; and gluing at least one second wood sheet onto a substrate.

18. A method for producing one or more second wood sheets from first wood sheets, comprising:

(i) providing first wood veneer sheets having a laminarly developed front side and backside, wherein the moisture content of the first wood sheets is below the fiber saturation point of the wood;

(ii) applying a water-comprising adhesive to at least one front side, at least one backside, or at least one front side and at least one backside of the first wood sheets wherein the water-comprising adhesive is an aqueous suspension of at least one organic polymer;

(iii) adhering the first wood sheets from (ii) and optionally from (i) with laminar sides to each other thereby forming a block of adhered layers, wherein the adhering is performed such as to increase the moisture content of the block of adhered layers is up to or above the fiber saturation point of the wood wherein the moisture content of the block of adhered layers is increased to 30-100%; and (iv) slicing the block of adhered layers to form at least one second wood sheet.

19. The method according to claim 18, further comprising:

(v) drying the second wood sheet or sheets until a moisture content below the fiber saturation point of the wood is reached.

* * * * *